US005584604A

United States Patent [19]

Österlund

[11] Patent Number: 5,584,604

[45] Date of Patent: Dec. 17, 1996

[54] APPARATUS FOR WINDING-UP A SELF-EXPANDING BOOM

[75] Inventor: Ansgar Österlund, Nordmaling, Sweden

[73] Assignee: Henrik Osterlund, Nordmaling, Sweden

[21] Appl. No.: 162,161

[22] PCT Filed: Jun. 14, 1991

[86] PCT No.: PCT/SE91/00433

§ 371 Date: Apr. 15, 1994

§ 102(e) Date: Apr. 15, 1994

[87] PCT Pub. No.: WO92/22711

PCT Pub. Date: Dec. 23, 1992

[51] Int. Cl.[6] ..... E02B 15/04

[52] U.S. Cl. ..... 405/68; 242/537; 405/63; 405/66

[58] Field of Search ..... 405/63, 66–69; 210/242.3; 242/537, 548, 597.5, 597.7, 604, 397.1, 397, 167

[56] References Cited

U.S. PATENT DOCUMENTS

| | | | |
|---|---|---|---|
| 3,798,911 | 3/1974 | Oberg | 405/69 |
| 3,971,220 | 7/1976 | Kinase et al. | 405/66 |
| 4,030,678 | 6/1977 | Simpson | 242/537 X |
| 4,117,991 | 10/1978 | Johnson | 242/532.6 |
| 4,198,010 | 4/1980 | Knap | 242/537 |
| 4,480,800 | 11/1984 | Oberg et al. | 405/68 X |

*Primary Examiner*—Dennis L. Taylor
*Attorney, Agent, or Firm*—Cushman Darby & Cushman IP Group of Pillsbury Madison & Sutro LLP

[57] ABSTRACT

An apparatus for booms, preferably so-called self-expanding booms, which includes a plate arranged on a platform, which plate is rotatable by a motor unit. The apparatus also includes a winder for winding up the boom. The winder is placed in the middle of the plate. A feeder for feeding-in the boom is arranged at an outer portion of the platform. The platform and the motor unit feeder are designed in that way that the later ones can be plugged into and out from the platform. The plate is designed in that way that it can be driven by a gear pinion which is arranged in the motor unit, and which goes into engagement with the plate when the motor unit is plugged into the platform. The feeder is designed and positioned in that way that the boom can be pressed togetherto a compact package when the boom is pulled-in, without need of extra guiding rolls.

6 Claims, 2 Drawing Sheets

APPARATUS FOR WINDING-UP A SELF-EXPANDING BOOM

BACKGROUND OF THE INVENTION

This invention relates to an apparatus for booms, preferably so-called self-expanding booms, which comprises a plate arranged on a platform, which plate is rotatable by means of a motor unit, and which comprises a means for winding-up the boom, which means is placed essentially vertically and essentially at the middle of the plate, and a means for feeding-in the boom, which means is arranged at an outer portion of the platform.

Such an apparatus is previously known from the granted Swedish patent application 429 143. This known apparatus has three guiding rolls placed on the platform itself at a distance from the means for winding up the boom, which rolls are connected together with the winding-up means by an overhead rod. This means that the known apparatus becomes unnecessarily expensive to manufacture.

SUMMARY OF THE INVENTION

This invention relates to a winding-up means, which is inexpensive to manufacture and which is effective to use when rolling-up the booms. The effectivity depends primarily on the fact that the motor unit and the means for feeding-in the boom simply can be plugged into and out of the platform.

BRIEF DESCRIPTION OF THE DRAWINGS

A preferred embodiment of the invention shall be described more closely below with reference to the accompanying drawings, wherein.

DETAILED DESCRIPTION

Figure 1:
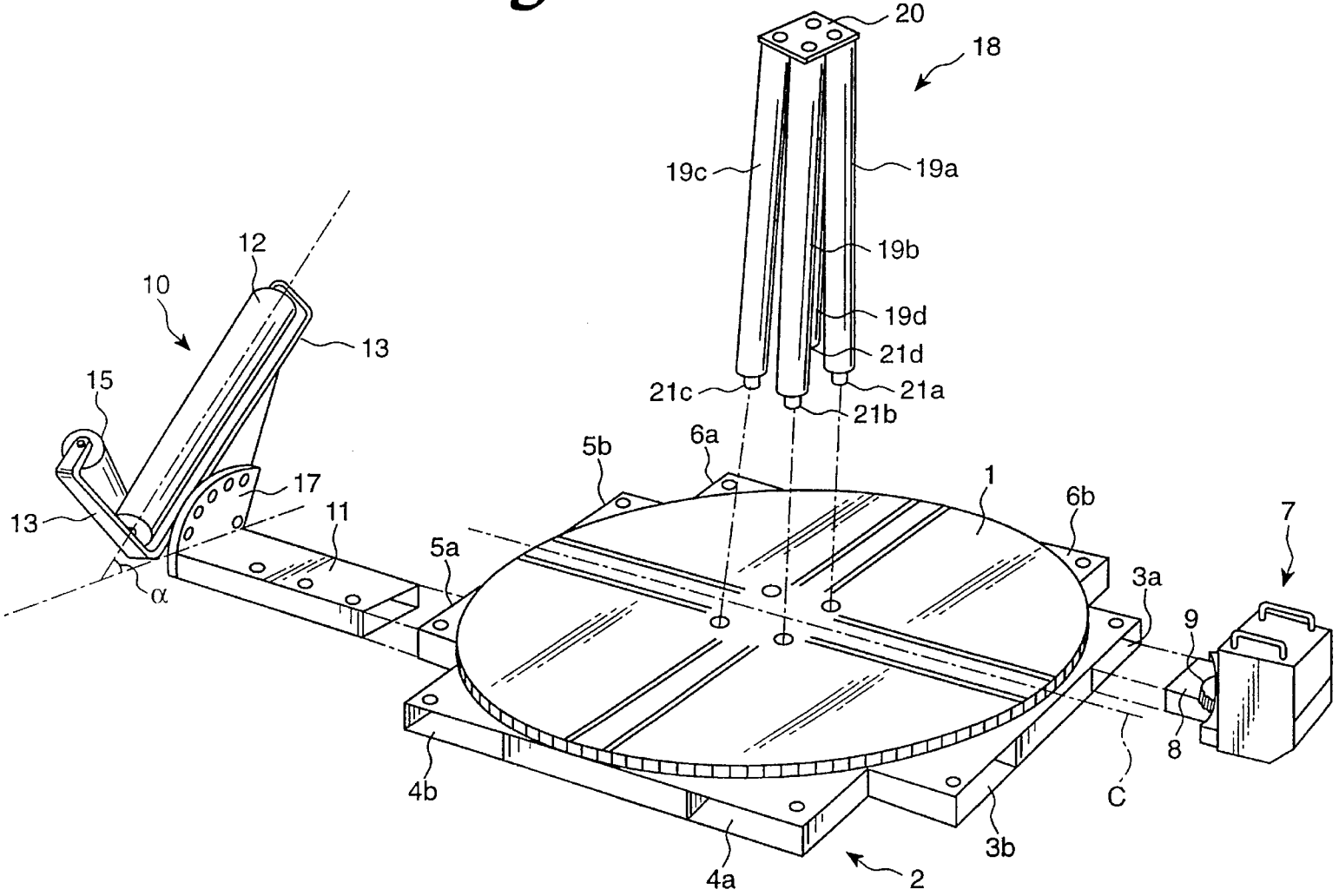
FIG. 1 shows the apparatus in a disjoined condition.

Referring to FIG. 1, there is shown there a preferred embodiment of the new apparatus. This one comprises a rotatable plate 1, which is arranged on a platform 2. This one comprises tubular plate girders which are arranged in that way that there are created two cavities 3*a, b*; 4*a, b*; 5*a, b*; 6*a, b* having rectangular cross-section at four areas outside the plate, each of which having an angular distance to each other of about 90°. In any one of these cavities, a motor unit 7, which is intended to rotate the plate 1, can be plugged in. In this connection, the male part 8 of the motor unit is projected into the cavity 3*a*. The motor unit comprises a gear pinion 9, which is intended to go into engagement with the plate 1 when the motor unit is plugged in, the peripheral portion of the plate being arranged in that way that it can receive the teeth of the gear pinion 9.

A means 10 for feeding in the boom is also intended to be plugged into the platform 2. This means has a relatively long male part 11 which in this case is intended to be introduced into the cavity 5*a*. The feeding means 10 is further provided with a first feeding roll 12, which is fastened in the frame 13 and which projects obliquely upwards in a direction forming the angle $\alpha$ with the horizontal line. The angle $\alpha$ suitably lies between 20° and 70°. The feeding roll 12 is intended to be in contact with the portion 14 of the floating body of the boom (see FIG. 2) when drawing in the boom. A second feeding roll 15 is fastened in the same frame 13 as the roll 12 and at essentially an angular distance of 90° from the same. This roll is intended to be in contact with the skirt portion 16 of the boom (see FIG. 2) when drawing in the boom, i.e. the portion which is fastened in the lower part of the floating body and which at the bottom is provided with weights, whereby the boom can be held in a correct position in the water.

The position of the frame 13 in relation to the male part 11 can be changed within certain areas by an adjusting means 17.

The apparatus further comprises a means 18 for winding-up the boom, which is detachably arranged essentially at the middle of the plate 1. This means 18 comprises four pipes 19*a–d* which at the top are kept together by a plate 20 and which at the bottom are fastened in a suitable way in the plate 1. This fastening can be made by means of four long bolts 21*a–d*, each of which penetrates a corresponding pipe. In that connection, the pipes 19*a–d* are arranged in that way that the means 18 has a conical form, the distance between the pipes being largest at the bottom.

Figure 2:
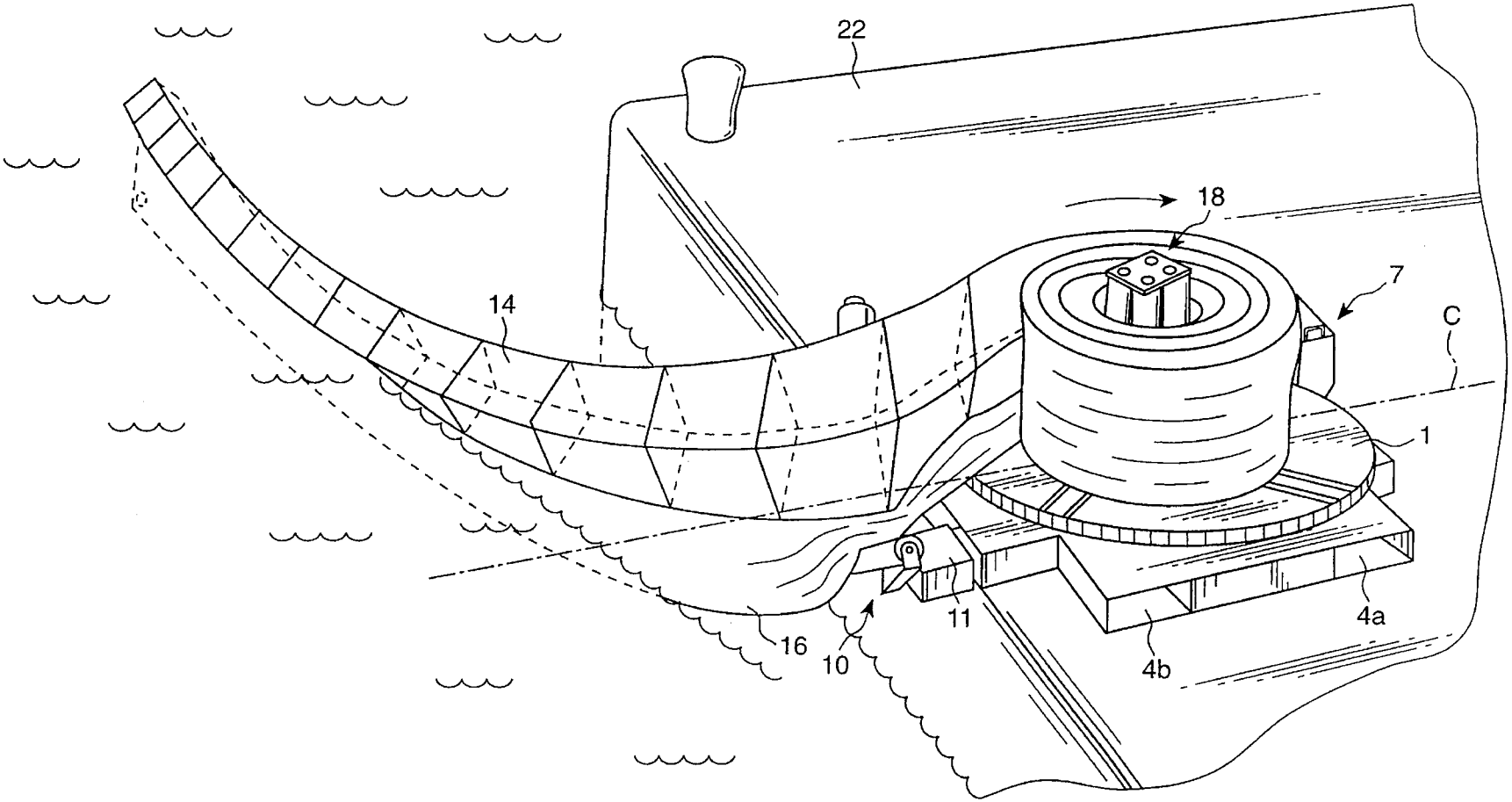
FIG. 2 shows the apparatus in an assembled condition with a boom during the winding up phase.

In FIG. 2 is shown the phase when a boom is wound-up. In that connection, the apparatus is positioned on a dock 22 or the like. As is apparent from FIG. 2, the boom can be wound-up effectively, i.e. air can be evacuated from the boom and this one can be wound-up to a compact package around the winding-up means 18 without the need of extra accessories, like guiding rolls. An essential point, in this connection, is that when winding-up the boom in a clockwise direction and if the boom is placed to the left of the apparatus, seen in the pulling-up direction, the feeding means shall be plugged into the cavity 5*a* which is positioned to the right of the center line c of the apparatus, seen essentially in the pulling-up direction. This has the consequence that when the rotation in the clock-wise direction of the plate starts, the boom will be pressed together when it passes by the feeding roll 12, so that a compact package of the boom is created around the winding-up means 18. When the winding-up phase is over, the bolts 21*a–d* are loosened, whereafter the pipes 19*a–d* due to the conical mounting arrangement simply can be lifted up. In that connection, the boom is made free and can be taken away to a storing space.

When winding-up a boom which is laid out to the right of the apparatus, seen in the winding-up direction, the feeding means ought to be plugged in the cavity 5*b*. Furthermore, the plate, in this case, ought to be rotated in the counter clock-wise direction. Due to that fact in the same way as previously there is a substantial change of the motion direction of the boom when pulling-in the same which has the consequence that the boom is pressed together effectively so that a compact package of the same will be created around the winding-up means.

Due to the fact that the motor unit 7 and the feeding means 10 easily can be plugged into and out of the platform, the apparatus is quick and simple to use. Moreover, the apparatus will be inexpensive to manufacture, when no extra accessories in the form of guiding rolls are needed.

The invention is, of course, not limited to the mentioned embodiment but can be modified within the scope of the following claims.

I claim:

1. Apparatus for winding-up a self-expanding boom, comprising:

a horizontally extending platform having an outer perimeter;

a horizontally extending circular plate supported on the platform for rotation about a central, vertical axis;

means defining a plurality of horizontally outwardly opening sockets in said perimeter of said platform, including two which are spaced about 90° to one another about said axis;

means defining a radially outwardly facing ring of gear teeth on said plate, centered on said axis;

a motor unit including a body mounting a gear for rotation about a second axis, a motor operable for rotating said gear about said second axis, and a prong removably plugged into one of said two sockets, for holding said motor unit with said gear engaged in driving, meshing engagement with said ring of gear teeth, so that operating said motor causes said table to rotate about said vertical axis;

an upstanding winder mounted centrally on said plate for rotation with said plate about said vertical axis, by having a prong thereof removably plugged into the other of said two sockets, for winding a self-expanding boom thereabout, onto said plate; and a feeder supported on said platform and having a first roller perimetrically arranged on said platform in a feeder from for rotation about a third axis which is disposed at an acute angle $\alpha$ to horizontal for rolling engagement with the boom as the boom is being wound about said winder onto said plate in a sense so as to compress said boom in a thicknesswise sense.

2. The apparatus of claim 1, wherein:

said platform is generally rectangular, so as to have four sides serially arranged at about 90° to one another;

said means defining at least one socket comprising a plurality of tubular girders of rectangular internal transverse cross-sectional cavity shape, said sockets being disposed two to a side on said platform, in pairs wherein the two sockets of each pair are located adjacent one another but on respective different ones of said sides.

3. The apparatus of claim 1, wherein:

said feeder further includes a second roller perimetrically arranged on said platform in said feeder frame for rotation about a fourth axis which is disposed at about a 90° angle to said third axis.

4. The apparatus of claim 3, further including:

an adjustable support for angularly adjustable orienting said feeder frame on said platform for varying said angle $\alpha$.

5. The apparatus of claim 1, wherein:

said plate includes means defining a group of four upwardly opening recesses; and said winder includes a group of four upwardly extending, upwardly mutually converging pipes, secured together at upper ends thereof, and having lower end features downwardly received in respective ones of said recesses for mounting said winder on said plate.

6. The apparatus of claim 3, wherein:

said angle $\alpha$ is between 20° and 70°.

* * * * *